US011280577B2

(12) United States Patent
Axelsson

(10) Patent No.: US 11,280,577 B2
(45) Date of Patent: Mar. 22, 2022

(54) GAS POWERED GUN

(71) Applicant: FX AIRGUNS AB, Mariestad (SE)

(72) Inventor: Fredrik Axelsson, Mariestad (SE)

(73) Assignee: FX AIRGUNS AB, Mariestad (SE)

( * ) Notice: Subject to any disclaimer, the term of this patent is extended or adjusted under 35 U.S.C. 154(b) by 0 days.

(21) Appl. No.: 17/191,856

(22) Filed: Mar. 4, 2021

(65) Prior Publication Data

US 2021/0278165 A1 Sep. 9, 2021

(30) Foreign Application Priority Data

Mar. 6, 2020 (EP) ..... 20161570

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC . F41B 11/723; F41B 11/62; F41B 11/72–724; B25C 1/00–188
USPC ..... 124/63–77
See application file for complete search history.

(56) References Cited

U.S. PATENT DOCUMENTS 5,280,778 A * 1/1994 Kotsiopoulos ..... F41A 19/02 124/31
5,462,042 A * 10/1995 Greenwell ..... F41B 11/62 124/56
7,765,997 B2 * 8/2010 Klockener ..... F41B 11/62 124/48
8,413,644 B2 * 4/2013 Masse ..... F41B 11/723 124/76
9,618,297 B2 * 4/2017 Axelsson ..... F41B 11/723
2003/0106545 A1 * 6/2003 Verini ..... F41B 11/724 124/74
2006/0278205 A1 * 12/2006 Axelsson ..... F41B 11/723 124/72
2010/0154766 A1 * 6/2010 Skilling ..... F41A 19/03 124/71
2011/0146646 A1 * 6/2011 Axelsson ..... F41B 11/62 124/71
2016/0153741 A1 * 6/2016 Axelsson ..... F41B 11/724 124/73
2016/0161225 A1 * 6/2016 Searle ..... G06F 11/3438 124/73
2016/0258710 A1 * 9/2016 Axelsson ..... F41B 11/723
(Continued)

FOREIGN PATENT DOCUMENTS

EP 3064885 A1 9/2016

OTHER PUBLICATIONS

European Search Report for EP Application No. 20161570.5 that is the parent application to the instant application; dated Oct. 5, 2020; 5 pages.

*Primary Examiner* — Michael D David
(74) *Attorney, Agent, or Firm* — Harness, Dickey & Pierce, P.L.C.; Anthony Fussner

(57) ABSTRACT

A gas powered gun for discharge of projectiles, comprising a valve arranged to exhaust compressed gas from a pressure chamber to thereby discharge a projectile inside a barrel, a hammer arranged to cooperate with the valve to open the valve, a movable spring abutment, a spring arranged between the hammer and the spring abutment and arranged to spring load the hammer in a spring loading direction towards said valve.

10 Claims, 6 Drawing Sheets

(56) References Cited

U.S. PATENT DOCUMENTS

| | | | | |
|---|---|---|---|---|
| 2016/0258711 | A1* | 9/2016 | Axelsson | F41B 11/723 |
| 2017/0336169 | A1* | 11/2017 | Axelsson | F41B 11/724 |
| 2021/0278165 | A1* | 9/2021 | Axelsson | F41B 11/62 |

* cited by examiner

GAS POWERED GUN

FIELD OF THE INVENTION

The present invention relates to a gas powered gun having a valve arranged to exhaust compressed gas from a chamber to thereby discharge a projectile inside a barrel, a hammer arranged to cooperate with a valve, a spring abutment, and a spring arranged between the hammer and the spring abutment and arranged to spring load the hammer in a spring loading direction towards the valve.

BACKGROUND ART

Gas powered guns of the above mentioned kind are well known in the art, and the compressed gas may be e.g. air (air guns).

The tension of the spring will determine the force of the hammer, and thus the time during which the valve is open. The stronger the spring force, the longer the valve will stay open, and the more gas will be exhausted into the barrel. And the more air, the higher speed of the discharged projectile.

Therefore, it is known to adjust the tension of the spring, typically by moving the spring abutment against which the spring rests. In most applications, such adjustment requires specific tools, and is only done during manufacturing.

It is known in the art, as outlined in EP 3 064 885 A1 by the same applicant as the present disclosure, to provide a velocity regulator that allows adjustment by the user. However, there is an ever increasing need and/or desire to provide alternative adjustments of the discharge speed in order to provide a velocity regulator that for instance facilitates providing ambidextrous gas powered guns and/or further simplifies the adjustment of the velocity provided by the gun.

SUMMARY OF THE INVENTION

In view of that stated above, the object of the present invention is to provide a gas powered gun which allows a user to easily adjust the exit velocity of the projectile.

To achieve at least one of the above objects and also other objects that will be evident from the following description, a gun having the features defined in claim 1 is provided according to the present invention. Preferred embodiments of the device will be evident from the dependent claims.

More specifically, there is provided according to the present invention a gas powered gun for discharge of projectiles. The gun comprises a valve arranged to exhaust compressed gas from a pressure chamber to thereby discharge a projectile inside a barrel, a hammer arranged to cooperate with the valve to open the valve, a movable spring abutment, a spring arranged between the hammer and the spring abutment and arranged to spring load the hammer in a spring loading direction towards the valve. The gun further comprises an adjustment mechanism including a rotatable cam member being rotatably arranged with a rotational axis substantially parallel to the spring loading direction. The rotatable cam member comprising a cam surface facing essentially in the spring loading direction and being configured to cooperate with the spring abutment which is pressed by the spring in the spring loading direction to rest against the cam surface so that, when the rotatable cam member the is turned around the rotational axis, the spring abutment will slide against the cam surface and move the spring abutment in the spring loading direction, to adjust a pretension of the spring. This provides adjustment of the exit velocity in a simple manner and by a mechanism having a relatively low complexity which provides high reliability. The rotatable cam member being arranged with the rotational axis being essentially parallel with the spring loading direction facilitates providing a compact gun.

The adjustment mechanism may further comprise a gripping portion arranged such that is accessible from outside the gun.

The gripping portion may further be arranged peripherally on the rotatable cam member.

The gripping portion may in one embodiment be arranged on a control member associated with said rotatable cam member such that rotation of the control member by a user results in a corresponding rotation of the rotatable cam member. The cam member may thus be arranged internally in a protected manner inside the gun, facilitating prevention of dust or dirt creating wear or undesired effects on the adjustment mechanism.

The rotatable cam member rotational axis may be arranged eccentrically in relation to the spring and/or in relation to the hammer.

The cam surface may further be a helical surface, the cam member being cylindrical and having the cam surface arranged peripherally one the flat side thereof intended to face the spring abutment.

The rotatable cam member may comprise a stop surface configured to engage the spring abutment to limit rotation of the rotatable cam member in the direction which causes the pretension of the spring to decrease.

The spring abutment may comprises a pin extending in the spring loading direction and being configured to slide against said cam surface.

The adjustment mechanism may further still comprise a shaft extending through the rotatable cam member, the shaft being attachable to the gun and extending essentially in the spring loading direction thereof. The shaft provides an easy way of attaching the cam member to the gun.

In one embodiment, the rotatable cam member is rotatable around the shaft.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. All the figures are highly schematic, not necessarily to scale, and they show only parts which are necessary in order to elucidate the invention, other parts being omitted or merely suggested.

Figure 1A:
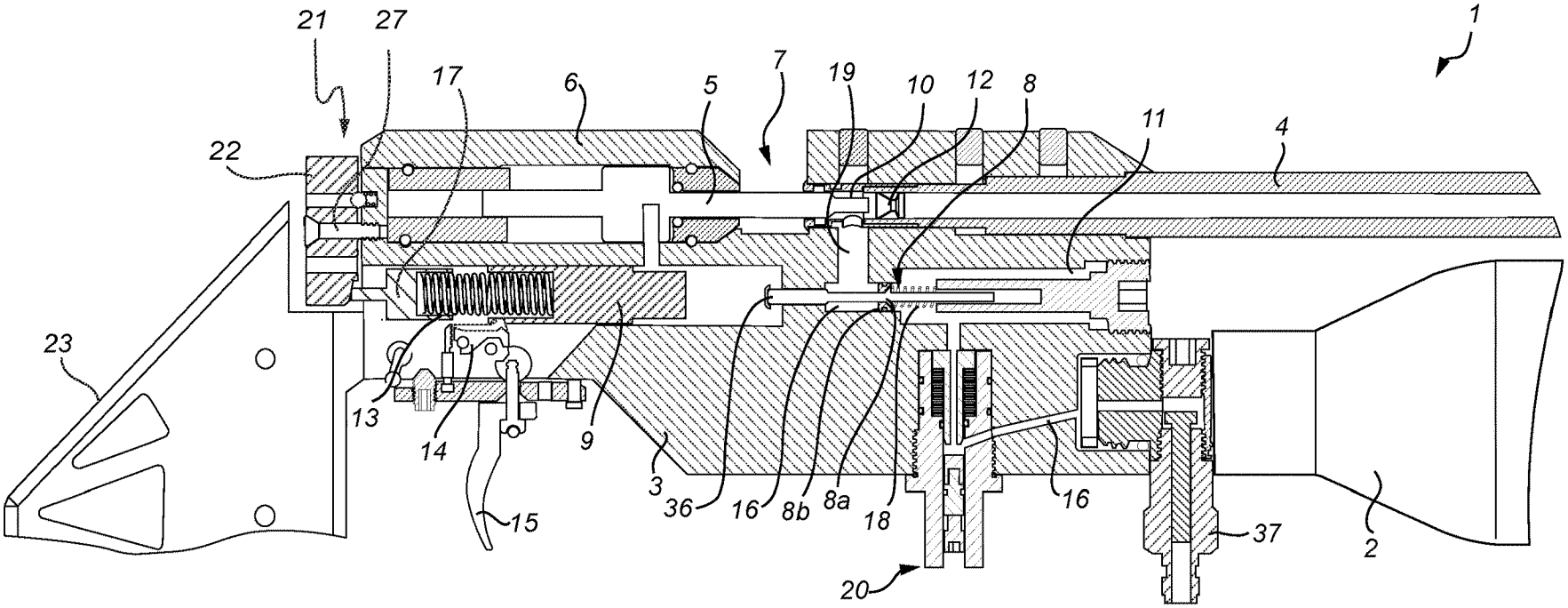
FIGS. 1*a* and 1*b* discloses a side view of a gas powered gun in loaded and fired state.
Figure 1B:
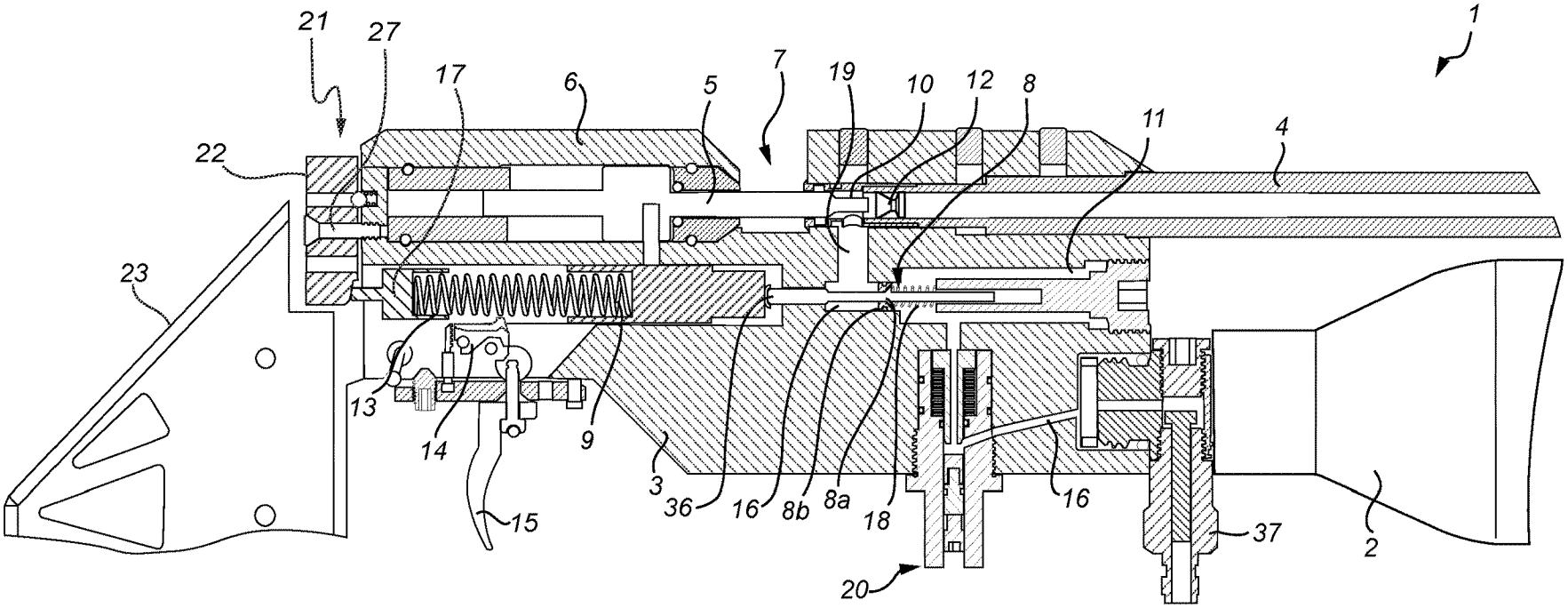

FIGS. 1*a* and 1*b* show a gas powered gun 1. The gun 1 is of the kind where a bottle 2 of compressed air or other gas is fitted to the body 3 of the gun 1. The compressed gas is fed to a pressure chamber 11 and when the trigger 15 of the gun 1 is pulled, the compressed air is forwarded to a space 10 behind a bullet 12 which fires the bullet 12. In more detail, the bottle 2 is connected to the gun 1 at the front. A connector 37 is arranged between the bottle 2 and the gun 1 and it is used to fill the bottle 2 with gas. The gun 1 also comprises a gas regulator 20. The gas regulator is a mechanical device, a valve, that controls the air pressure in the pressure chamber 11. A passage 16 in the gun body 3 forwards the gas from the container 2 into the regulator 20, which forwards the gas into the pressure chamber 11 and regulates the gas pressure in the pressure chamber 11. This means that the pressure is always the same and hence an airgun with a regulator shoots with very predictable velocity.

The gun 1 further comprises a barrel 4, and a feeder pin 5 slidably arranged in a housing 6 behind the barrel 4. In a space between the barrel 4 and the feeder pin 5 is fitted a magazine (not shown) to an inlet 7 for providing projectiles, e.g., in the form of diabolo bullets 12. The feeder pin 5 is arranged to be slid back, thereby allowing a bullet to be provided from the magazine, and then to be slid forward, thereby feeding the bullet 12 into a firing position in the barrel 4, as shown in FIGS. 1*a* and 1*b*.

The gun 1 further comprises an open-close valve 8, which is arranged in the pressure chamber 11 for allowing passage of compressed gas from the bottle 2 to the space 10 immediately behind the bullet 12 in the barrel 4, and a sliding hammer 9, which actuates the open-close valve 8 at the moment of firing. When the gun is in a loaded position the hammer 9 is biased towards the valve 8 by a biasing spring 13, and is held in a loaded position, against the force of the biasing spring 13, by a catch 14 (see FIG. 1*a*). A trigger 15 is arranged to actuate the catch 14 in order to release the hammer 9. After firing the gun 1 the hammer 9 is brought back to its loaded position. The trigger-stopper-cooperation can be done in many different ways and will not be explained further since this is common knowledge to the person skilled in the art.

In the illustrated example, the open-close valve 8 has a main body oriented essentially in the longitudinal direction of the gun 1 and comprises a valve head 8*a* adapted to cooperate with an opening of the pressure chamber 11 in front of the valve 8, the opening thus acting as a valve seat 8*b*. The pressure inside the pressure chamber 11 keeps the valve head 8*a* in place against the valve seat 8*b*, thus effectively sealing the pressure chamber 11. The valve head 8*a* is additionally biased against the valve seat 8*b* by a biasing spring 18. Another channel 19 connects a passage 16 behind the valve seat 8*b* with the space 10 behind a bullet 12 in the barrel 4. When the hammer 9 is released it is forced by the spring 13 into contact with a portion 36, to which said valve head 8*a* is a part of. This is shown in FIG. 1*b*. The hammer 9 pushes the valve head 8*a* out of sealing contact with the valve seat 8*b* (not shown) to thereby allow an exhaust of gas through the channel 19 to the space 10 behind the bullet 12. However, many other solutions for an open-close valve 8, to be actuated by the hammer 9, are possible.

FIG. 1*a* shows the gun in a ready-for-fire-position. In this condition, the feeder pin 5 has been slid into the barrel 4, and fed the bullet 12 into the firing position. The hammer 9 is in a loaded position and the valve 8 seals the pressure chamber 11. When the hammer 9 is in a loaded position it is held in place by the catch 14, against the force of the biasing spring 13. The pressure chamber 11 has been filled with high pressure air from the bottle 2 to a pressure regulated by the regulator 20. Once released by actuation of the trigger 15, the hammer 9 and valve 8 interaction will determine the velocity with which the bullet 10 exits the barrel 4. The gas regulator 20 determines the pressure of the gas that is released by the bottle 2, and in order to determine the amount of time that this pressure is exerted onto the bullet 12 is an adjustment mechanism 10 provided. The adjustment mechanism 21 thus allows adjustment of the exiting velocity of the bullet 12 that is accessible to the user of the gun 1 for any given pressure provided by the gas regulator 20.

The adjustment mechanism 10 functions by altering the pretension of the spring 13 by axially moving a spring abutment 17 against which the spring 13 abuts. Movement of the spring abutment 17 to the right in FIGS. 1*a* and 1*b*, towards the hammer 9, causes an increase in the pretension of the spring and vice versa. An increase in the pretensioning force equates to the hammer 9 striking the portion 36 of the valve head 8*a* with a higher velocity and momentum thus causing it to stay open for longer against the air pressure in the chamber 11 and against the force of the biasing spring 18. The opposite is true for a decrease in the pretensioning force of the spring 13.

Figure 2:
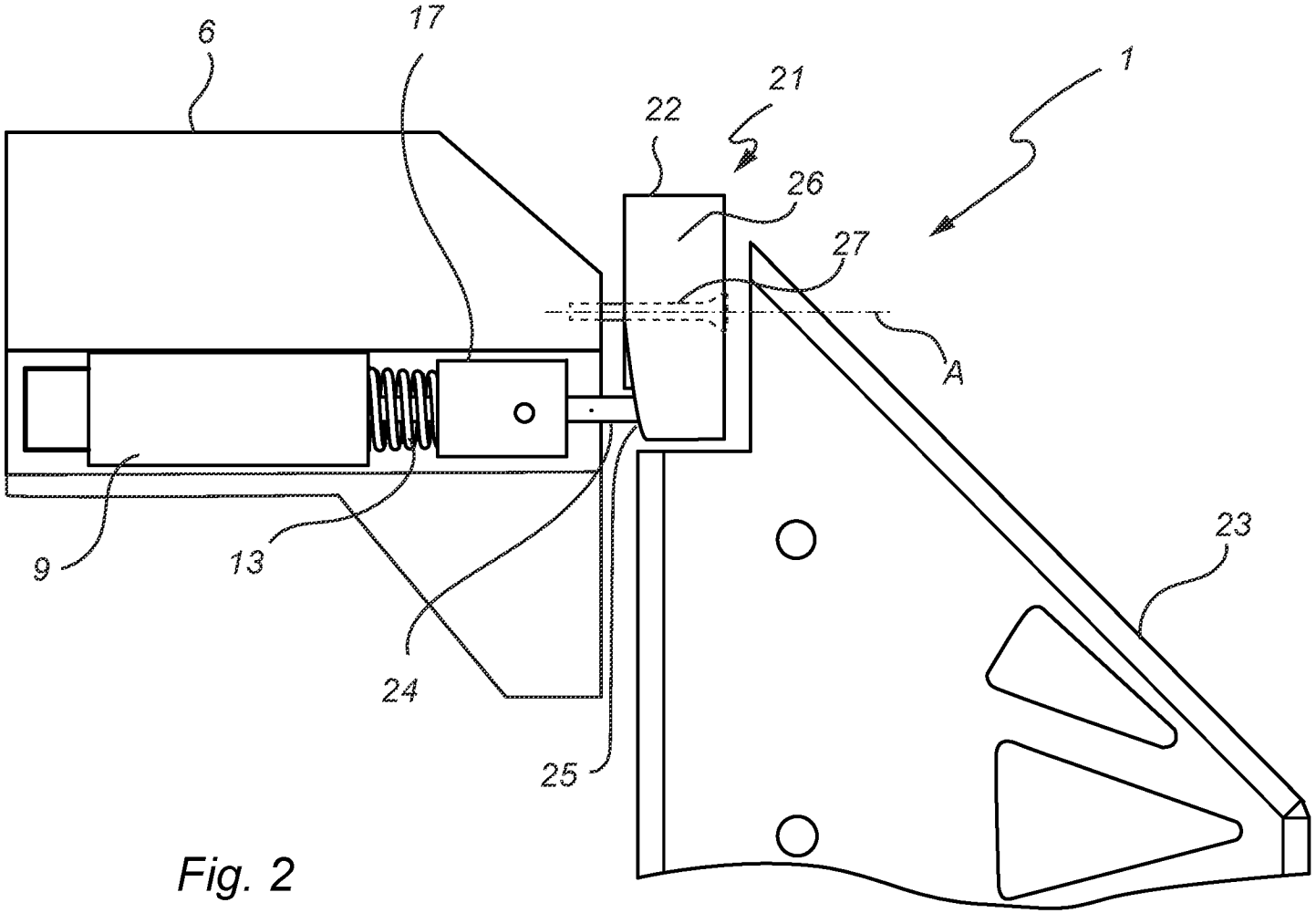
FIG. 2 discloses a side view of a rear portion of a gas powered gun.

In FIG. 2 is a detail view of the gun 1 shown where several components are omitted for illustrative purposes. The adjustment mechanism 21 comprises a rotatable cam member 22. The rotatable cam member 22 is rotatably arranged in relation to the gun 1 with a rotational axis A which is essentially parallel to the spring loading direction of the spring 13.

The rotatable cam member 22 comprises a cam surface 25 facing essentially in the spring loading direction. I.e. the cam surface 25 faces towards the spring abutment 17 and the spring 13, and is configured to cooperate with the spring abutment 17. In one embodiment (not shown), an intermediate follower may be provided which is arranged between the cam surface 25 and the spring abutment 17 for instance for allowing separation of the rotatable cam member 22 and the spring abutment 17.

The spring abutment 17 (or an associated follower as mentioned above) is pressed by the spring 13 in the spring loading direction to rest against the cam surface 25. When the rotatable cam member 22 is turned around its rotational axis A, the spring abutment 17 will move in the spring loading direction, either towards or away from the hammer 9, to thereby adjust the pretension of the spring 13.

As is also shown in FIG. 2, the adjustment mechanism 21 may comprise a shaft 27 extending through the rotatable cam member 22, the shaft 27 being attachable to the gun 1 and extending essentially in the spring loading direction thereof. The shaft 27 forms an axle around which the rotatable cam member 22 can rotate. The shaft 27 may be arranged in a centre hole 33 (shown in FIGS. 3-5) in the cam member 22. It may further be configured to provide an axial stop for the the rotatable cam member 22 such that the rotatable cam member 22 can withstand the forces generated by the spring 13 without being axially displaced. The shaft 27 may be threaded such that it can be screwed into the housing 6 and thus attach the cam member 22 to the gun 1.

Rotation of the rotatable cam member 22 in one direction causes the spring abutment 17 to move towards the hammer 9 and vice versa which is determined by the shape of the cam surface 25 as will be explained further in relation to FIGS. 4-6. The spring abutment 17 may comprise a pin 24 extending in the spring loading direction and being configured to slide against the cam surface 25. The pin 24 and the cam abutment 17 may be integrally formed and/or as separate parts that are connectable to each other. In one embodiment, pin 24 is in threaded engagement with the spring abutment 17 such that it allows even further adjustment of the adjustment mechanism 21 for instance to calibrate the adjustment mechanism 21.

The adjustment of the adjustment mechanism 21 should be easily accessible for the user of the gun 1, preferably regardless of if the person is holding the gun 1 with the right or left hand. This is achieved as a the adjustment mechanism 21 comprises a gripping portion 26 arranged such that is accessible from outside the gun 1. In the embodiment shown in FIG. 2, the gripping portion 26 is formed on the outer periphery of the cam member 22 which is arranged between the housing 6 and a handle/stock 23 of the gun 1 such that it a large portion of it can be accessed by a user from either side of the gun 1 and/or from above the gun 1. It can thus be adjusted with the free hand that is not holding the gun 1 regardless of this is the left or right hand of the user.

Figure 3:
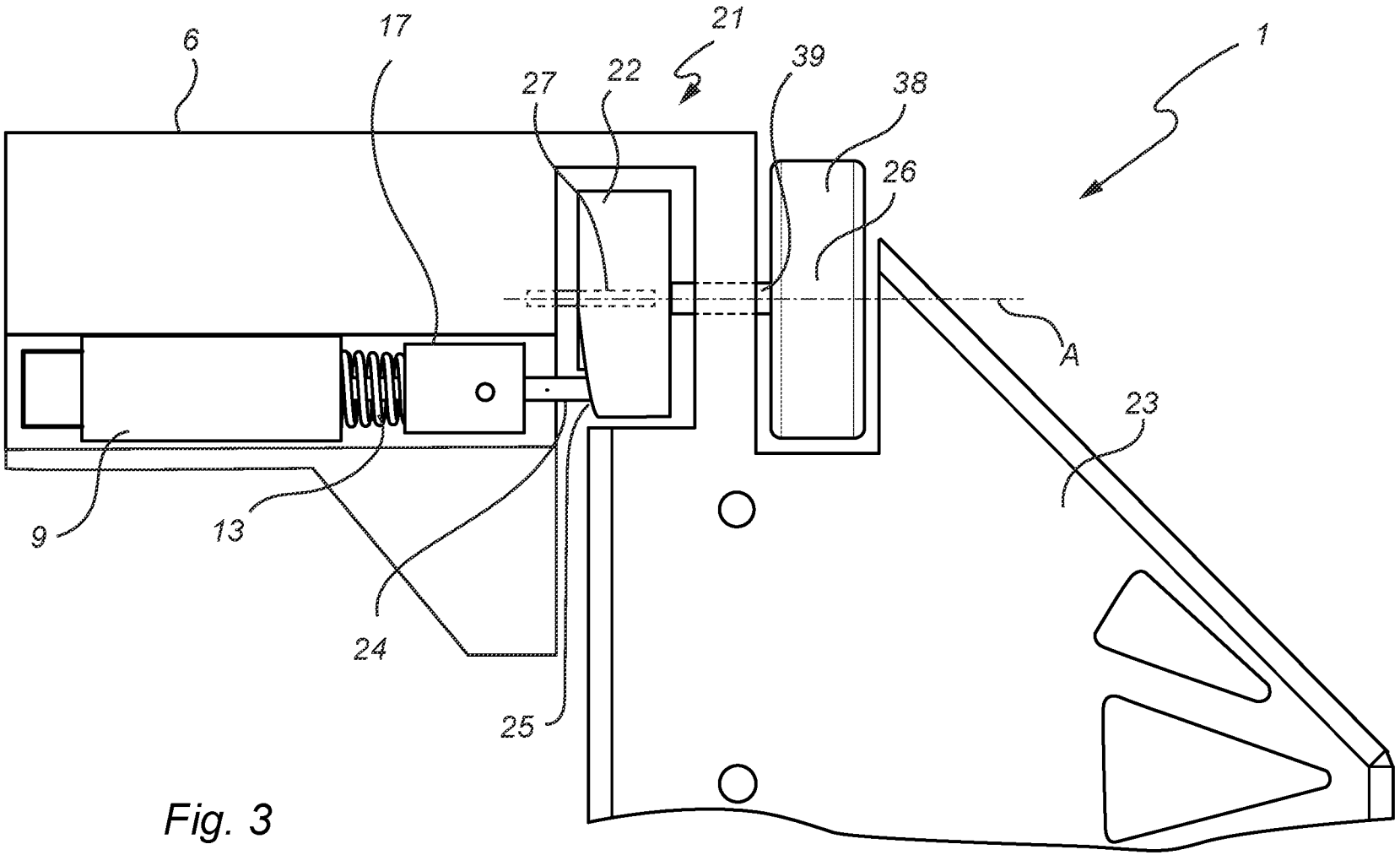
FIG. 3 discloses a side view of a rear portion of a gas powered gun.

In one embodiment shown in FIG. 3, the gripping portion 26 is arranged on a control member 38 associated with the rotatable cam member 22 such that rotation of the control member 38 by a user results in a corresponding rotation of the rotatable cam member 22. It may be preferred to arrange the cam member 22 internally inside the gun 1, whereby a separate control member 38 such as a control wheel may be arranged accessible to the user of the gun 1. The control member 38 may be connected to the rotatable cam member 22 by means of a shaft 39 and/or e.g. by means of a splined or geared connection or similar. Having the cam member 22 and the interface between the cam surface 25 and the spring abutment 17 arranged inside of the gun 1, e.g. withing the housing 6, may provide benefits in terms of protecting the adjustment mechanism 21 from dirt or dust that may otherwise cause increased wear.

The rotatable cam member 22 may further be arranged with its rotational axis A being eccentrically arranged, i.e. radially offset, in relation to the centre axis of the spring 13 and/or the spring abutment 17 and/or the hammer 9. This facilitates keeping the overall length of the gun 1 down as the spring 13, the spring abutment 17, the hammer 9 and the valve 8 can be arranged below the barrel 4 and the feeder pin 5 while the barrel 4 and/or the feeder pin 5 may be arranged closer to the cam member 22.

Figure 4:
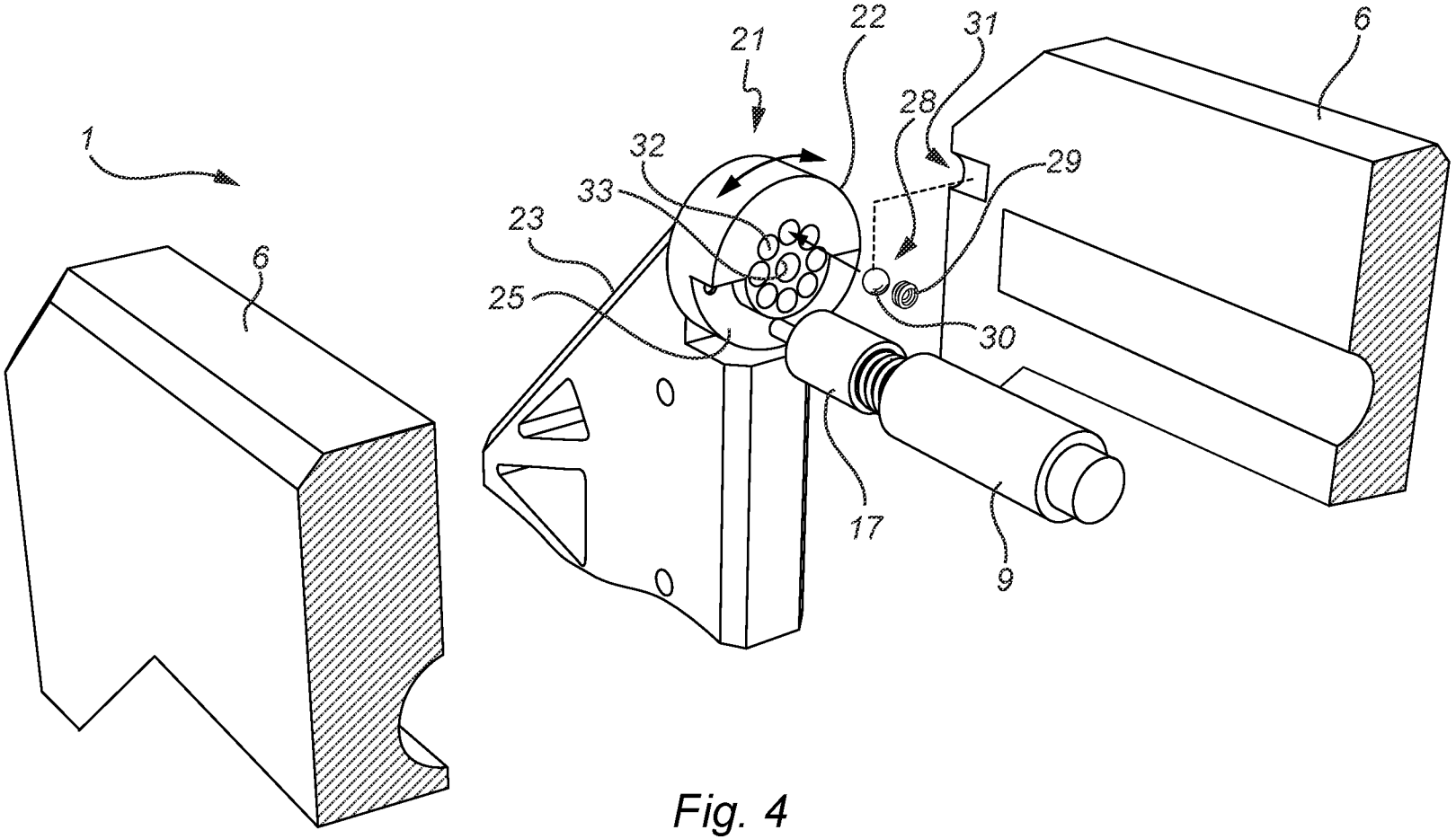
FIG. 4 discloses an exploded perspective view of a gas powered gun.

Now referring to FIG. 4 which shows an exploded perspective view of the gun 1 and the adjustment mechanism 21. It can be seen that the adjustment mechanism 21 may further comprise a positioning mechanism 28. The positioning mechanism 28 comprises a small ball 30, or pin, and is configured to be arranged in a groove or hole 31 in the housing 6. It further comprises a spring 29 which biases the ball 30 towards the cam member 22. The ball 30 is pressed by the spring 29 into one of a plurality of indentations 32 on the cam member 22, thereby locking the cam member 22 in a predefined position.

When the rotatable cam member 22 is turned, the ball 30 will slide or roll out of the indentation 32 and then against the surface of the cam member 22 until it engages another one of the indentations 32. In this way, the rotatable cam member 22 can be locked in one of a plurality of predefined positions.

Figure 6:
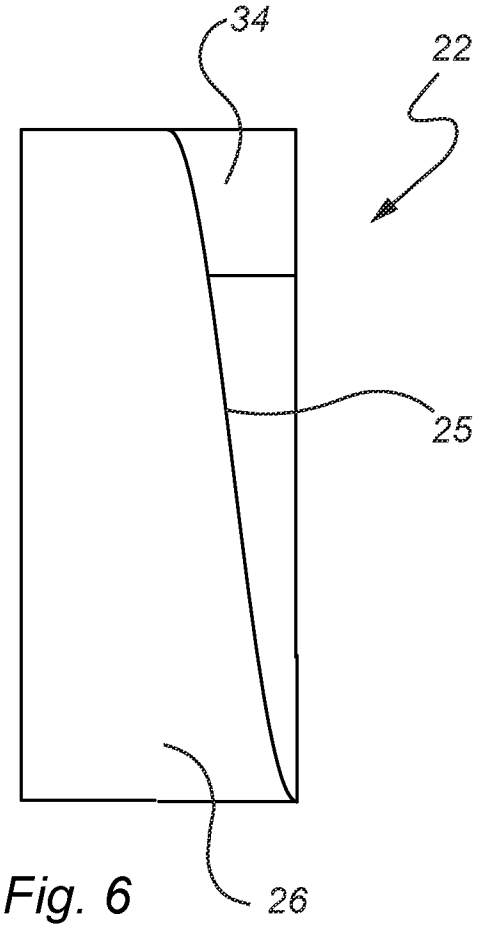
FIGS. 5 and 6 disclose a perspective and a side view of a cam member respectively.
Figure 5:
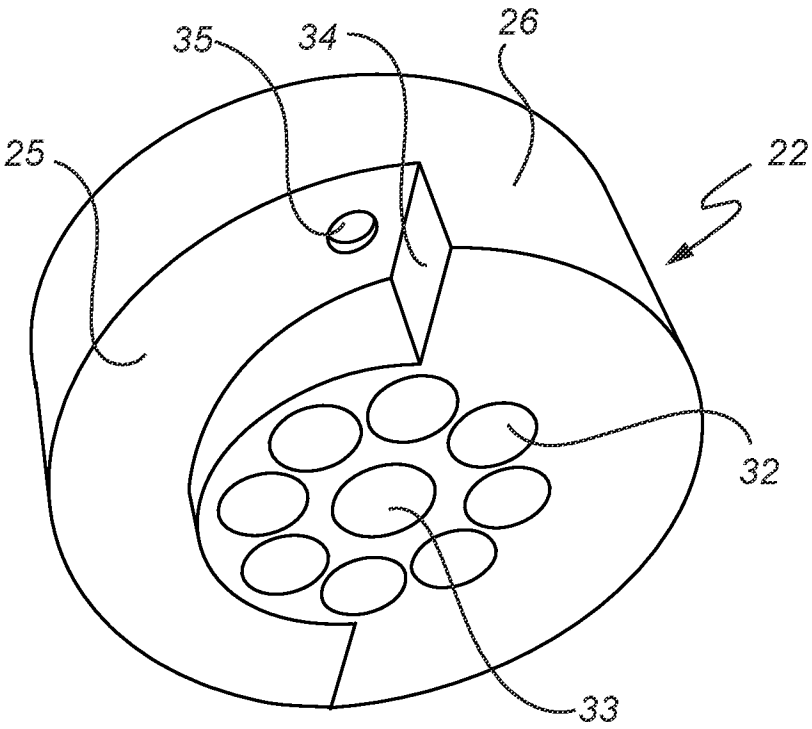

With simultaneous reference to FIGS. 5 and 6, of which FIG. 5 shows a perspective view of the cam member 22 and FIG. 6 shows a side view of the cam member 22. The cam member 22 is preferably cylindrical in shape and having one side facing away from the spring abutment 17 and another side being provided with the cam surface 25 that faces against the spring abutment 17. The cam surface 25 on the rotatable cam member 22 may be a helical surface. The cam surface 25 may be arranged on the peripheral portion of the cam member 22 on the side thereof that is intended to face the spring abutment 17, allowing the rotational axis A of the cam member 22 to be offset from the centre axis of the spring 13, the spring abutment 17 and the hammer 9.

The inclination of the helical cam surface 25 determines the linear translation of the spring abutment 17 when the rotatable cam member 22 is turned by a certain degree by a user. A stop surface 34 may further be provided which is configured to engage the spring abutment 17, preferably the pin 24 thereof, to limit the rotation of the cam member 22. In one embodiment, the rotatable cam member 22 is provided with a through-hole 35 arranged extending through the rotatable cam member 22. Preferably, the through-hole 35 is arranged with one of its openings on the cam surface 25 such that the pin 24 can be accessed with a tool through the through-hole 35 from the side on the cam member 22 opposite the cam surface 25. This is especially beneficial as the pin 24 may be in threaded or at least axially adjustable engagement with the spring abutment 17 such that the length or protrusion of the pin 24 from the spring abutment 17 can be adjusted. The pin 24 can consequently be adjusted with a tool through the through-hole 35 without having to remove the cam member 22. The pin 24 could, as mentioned, be adjusted for instance for calibration of the adjustment mechanism 21.

It will be appreciated that the present invention is not limited to the embodiments shown. Several modifications and variations are thus conceivable within the scope of the invention which thus is exclusively defined by the appended claims.

What is claimed is:

1. A gas powered gun for discharge of projectiles, comprising:

a valve arranged to exhaust compressed gas from a pressure chamber to thereby discharge a projectile inside a barrel;

a hammer arranged to cooperate with said valve to open said valve;

a movable spring abutment;

a spring arranged between said hammer and said spring abutment and arranged to spring load said hammer in a spring loading direction towards said valve;

an adjustment mechanism including a rotatable cam member, being rotatably arranged with a rotational axis substantially parallel to said spring loading direction, the rotatable cam member comprising a cam surface facing essentially in said spring loading direction and being configured to cooperate with the spring abutment which is pressed by said spring in said spring loading direction to rest against said cam surface, so that, when said rotatable cam member is turned around said rotational axis, said spring abutment will slide against said cam surface and move said spring abutment in said spring loading direction, to thereby adjust a pretension of said spring.

2. The gun according to claim 1, wherein the adjustment mechanism comprises a gripping portion arranged such that is accessible from outside the gun.

3. The gun according to claim 2, wherein the gripping portion is arranged peripherally on the rotatable cam member.

4. The gun according to claim 2, wherein the gripping portion is arranged on a control member associated with said rotatable cam member such that rotation of the control member by a user results in a corresponding rotation of the rotatable cam member.

5. The gun according to claim 1, wherein the rotatable cam member rotational axis is arranged eccentrically in relation to the spring and/or in relation to the hammer.

6. The gun according to claim 1, wherein the cam surface is a helical surface.

7. The gun according to claim 1, wherein the rotatable cam member comprises a stop surface configured engage the spring abutment to limit rotation of the rotatable cam member in the direction which causes the pretension of the spring to decrease.

8. The gun according to claim 1, wherein the spring abutment comprises a pin extending in the spring loading direction and being configured to slide against said cam surface.

9. The gun according to claim 1, wherein the adjustment mechanism comprises a shaft extending through the rotatable cam member, the shaft being attachable to the gun and extending essentially in the spring loading direction thereof.

10. The gun according to claim 9, wherein the rotatable cam member is rotatable around the shaft.

* * * * *